United States Patent [19]

Kishimoto

[11] 4,272,616

[45] Jun. 9, 1981

[54] PHOTOGRAPHIC RADIATION-SENSITIVE MATERIALS HAVING IMPROVED ANTISTATIC PROPERTY

[75] Inventor: Shinzo Kishimoto, Minami-ashigara, Japan

[73] Assignee: Fuji Photo Film Co., Ltd., Minami-ashigara, Japan

[21] Appl. No.: 46,279

[22] Filed: Jun. 7, 1979

[30] Foreign Application Priority Data

Jun. 7, 1978 [JP] Japan ..... 53/68636

[51] Int. Cl.[3] ..... G03C 1/78

[52] U.S. Cl. ..... 430/529; 252/518; 252/521; 430/528; 430/530; 430/637

[58] Field of Search ..... 96/87 A, 114.2; 430/527, 528, 530, 637, 529; 252/521, 518

[56] References Cited

U.S. PATENT DOCUMENTS

| | | | |
|---|---|---|---|
| 2,357,380 | 2/1944 | Brant | 96/87 A |
| 2,725,297 | 11/1955 | Morey | 96/87 A |
| 3,428,456 | 2/1969 | Grabhoefer | 96/87 |
| 3,552,972 | 1/1971 | Meyer | 96/87 A |
| 3,769,022 | 10/1979 | Ville et al. | 96/87 A X |

FOREIGN PATENT DOCUMENTS

| | | | |
|---|---|---|---|
| 687558 | 9/1951 | United Kingdom | 96/87 A |
| 861134 | 2/1961 | United Kingdom | 96/87 A |

OTHER PUBLICATIONS

Chem. Abstracts, vol. 67, 44379t, Fr. Pat. No. 1,466,072, Clovis.

Chem. Abstracts, vol. 88, 161400n, Gallyamov et al., 1977.

Chem. Abstracts, vol. 74, 8364v, Fr. Pat. No. 1,585,604, Villain.

*Primary Examiner*—Edward C. Kimlin

*Attorney, Agent, or Firm*—Sughrue, Rothwell, Mion, Zinn and Macpeak

[57] ABSTRACT

Photographic radiation-sensitive materials having an improved antistatic property which comprise a non-ionic polyoxyethylene surface active agent and at least one of a thiocyanate, iodide, perchlorate and periodate in at least one layer.

10 Claims, No Drawings

PHOTOGRAPHIC RADIATION-SENSITIVE MATERIALS HAVING IMPROVED ANTISTATIC PROPERTY

BACKGROUND OF THE INVENTION

1. Field of the Invention

The present invention relates to photographic sensitive materials having an improved antistatic property and, particularly, to photographic sensitive materials having an excellent antistatic property which comprise a nonionic polyoxyethylene surface active agent and at least one of a thiocyanate, iodide, perchlorate and periodate in at least one layer.

2. Description of the Prior Art

In photographic sensitive materials, photographic light-sensitive emulsion layers and, if necessary, layers composing the photographic sensitive material, such as an intermediate layer, a protective layer, a back layer and an antihalation layer, etc., are provided on one or both surfaces of a base such as a film of a poly-α-olefin such as polyethylene or polystyrene, a cellulose ester such as cellulose triacetate, or a polyester such as polyethylene terephthalate, paper, synthetic paper or a paper sheet both surfaces of which are coated with said high molecular materials, through a subbing layer which is provided in order to firmly bond the base to the photographic emulsion layers.

As photographic sensitive materials in which photographic emulsions are applied to both surfaces of the base there are, for example, direct X-ray films. In most other photographic sensitive materials, the photographic emulsions are generally applied to only one surface of the base.

Accordingly, in the latter case, there is one face to which the photographic emulsions are not applied, namely, the base surface which is generally referred to as the back face. Since the photographic sensitive materials are composed of a base having an electrically insulating property and photographic layers, electrostatic charges often accumulate as a result of contact and friction between surfaces of the same or different materials or separation thereof in producing the photographic sensitive materials or upon use.

The accumulated electrostatic charges create many troubles. For example, in the photographic films before development processing, the photosensitive emulsion layers are exposed to light by discharging the accumulated electrostatic charges whereby dot spots or branch-like or feather-like specks are formed when the photographic films are developed. They are so-called static marks by which the commercial value of the photographic films remarkably diminishes and sometimes is completely lost. For example, if they appear on medical or industrial X-ray films they may result in erroneous diagnosis. Since these marks are not revealed until development, it is one of the most troublesome problems. Further, the accumulated electrostatic charges bring adhesion of dust to the surface of the film, by which secondary troubles such as uneven coating at application, etc., result.

Such electrostatic charges often accumulate when the photographic sensitive materials described above are produced or used. For example, the electrostatic charges may be generated by friction due to contact of the photographic film with rolls during production, or by separation of the emulsion face from the base face in the step of winding and rewinding the photographic film. Further, in finished goods, the electrostatic charges may be generated as the emulsion face passes over the base face during rewinding of the photographic film under high humidity conditions sufficient to cause adhesion, or they may be generated by contact or separation of the X-ray film with mechanical parts or a fluorescent sensitizing paper in an automatic camera. Further, charges may be generated by contact with packing materials. Static marks on the photographic sensitive materials induced by accumulation of the electrostatic charges remarkably increase with an increase in the sensitivity or the processing rate of the photosensitive materials.

Though it is believed that charges originating by contact and the charges originating by separation result from an ionic interaction between the molecules of the contacting materials, it is difficult at the present time to surmise what material charges are positive and what material charges are negative. However, it is clear that such charging can be prevented, if the electric pressure is reduced or if conductivity of the surface of the material is increased so as to remove the electrostatic charge in a very short time before the electrostatic charge accumulates and partial discharging occurs.

Therefore, it has been hitherto proposed to increase the conductivity of the base or the coating surface layer of the photographic sensitive materials, and various hygroscopic materials or water-soluble inorganic salts, certain surface active agents and polymers, etc., have been used to this end. For example, polymers described in U.S. Pat. Nos. 2,882,157, 2,972,535, 3,062,785, 3,262,807, 3,514,291 and 3,615,531, surface active agents described in British Pat. No. 861,134 and U.S. Pat. Nos. 2,982,651, 3,428,456, 3,457,076, 3,454,625, 3,552,972 and 3,655,387, and zinc oxide, semiconductors and colloidal silica described in U.S. Pat. Nos. 3,062,700, 3,245,833 and 3,525,621 have been used to increase the conductivity of the base or the surface.

As a method of rendering the base of a photographic film antistatic directly, the above-described materials have been incorporated directly in a polymeric material and used as the base or they have been applied to the surface of the base. In the latter case, the antistatic agent is applied to a back layer alone or together with a polymer such as gelatin, polyvinyl alcohol or cellulose acetate, etc. Further, antistatic agents have been incorporated in a photographic emulsion layer or a surface protective layer and an aqueous solution of the antistatic agent has been applied to the surface of said layer to impart antistatic properties to the material. However, many of these materials are useful with only one kind of film base or photographic composition. Though some of these agents produce good results on a specific film base or photographic emulsion or on other photographic elements, they do not prevent charging on other film bases or photographic elements and sometimes they have a bad influence on photographic properties.

Generally, for high speed emulsions, there are a small number of materials which show a satisfactory antistatic effect under low humidity (30% RH or less), but the antistatic effect deteriorates and adhesion problems result under a high temperature and a high humidity. Particularly, in sensitive materials in which a photographic emulsion is applied to both surfaces of the base, such as direct X-ray sensitive materials, it is difficult to establish techniques for effectively utilizing the antistatic agents. Further, in case of searching for antistatic agents used for photographic sensitive materials, it is necessary to take into consideration not only photographic properties of photographic emulsions (such as sensitivity, fog, granularity or sharpness, etc.), but also coefficient of friction, good camera behavior and a good anti-adhesive property, etc.

SUMMARY OF THE INVENTION

Accordingly, one object of the present invention is to provide a photographic sensitive material in which the antistatic property is improved by reducing surface resistance and reducing electrostatic pressure at the same time without damaging other properties.

Another object of the present invention is to provide a photographic sensitive material which does not suffer heavily from static marks which can be generated during production and use.

A further object of the present invention is to provide a photographic sensitive material containing at least one layer, which is preferably a surface layer or a back layer, containing a novel combination of antistatic agents.

The present inventors have found that these objects can be attained by incorporating a nonionic polyoxyethylene surface active agent and at least one of a thiocyanate, iodide, perchlorate and periodide in at least one layer of the photographic sensitive material.

DETAILED DESCRIPTION OF THE INVENTION

It has been described in, for example, British Patent 861,134 and Japanese Patent Application (OPI) 57427/75 (the term "OPI" as used herein refers to a "published unexamined Japanese patent application") that nonionic polyoxyethylene compounds exhibit an antistatic effect themselves. However, the antistatic effect is not always sufficient when the nonionic polyoxyethylene compounds are used alone. On the other hand, though it has been known that some inorganic salts exhibit an antistatic effect, the effect is entirely unsatisfactory when they are used alone.

In the present invention, it has been found that, when the nonionic polyoxyethylene compounds are used together with specific inorganic salts, the surface resistivity is remarkably reduced and the electrostatic charge is reduced at the same time, whereby the antistatic effect is remarkably improved. In the following, the nonionic surface active polyoxyethylene compounds and inorganic salts used in the present invention are described.

The nonionic polyoxyethylene compounds suitably used in the present invention include compounds represented by the following formulae (I) to (XVI). Concerning surface activity of these compounds, it is preferred that surface tension of an aqueous solution thereof is about 45 dynes/cm or less at a concentration higher than the critical concentration for micelle formation.

$$HO(CH_2CH_2O)_a(\underset{\underset{CH_3}{|}}{CH}CH_2O)_b(CH_2CH_2O)_cH \quad (I)$$

where a+c is about 10 to 80, wherein either a or c may be 0 and b is about 5 to 200

$$RCOO(CH_2CH_2O)_nH \quad (II)$$

where R is an alkyl group and preferably an alkyl group having 3 to 21 carbon atoms and n is about 5 to 135

$$R^1COO(CH_2CH_2O)_nOCR^2 \quad (III)$$

where $R^1$ and $R^2$ which may be the same or different each represents an alkyl group, wherein the sum total of carbon atoms in $R^1$ and $R^2$ is preferably 6 to 34 and n is about 5 to 100

$$R^3O(CH_2CH_2O)_nH \quad (IV)$$

where $R^3$ is an alkyl group and preferably an alkyl group having 4 to 22 carbon atoms, which may be substituted by fluorine atoms and n is about 3 to 50

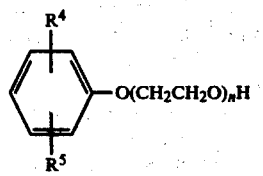

(V)

where $R^4$ and $R^5$ which may be the same or different are each a hydrogen atom or an alkyl group (preferably an alkyl group having 1 to 9 carbon atoms) which may be substituted by fluorine atoms and n is about 3 to 150

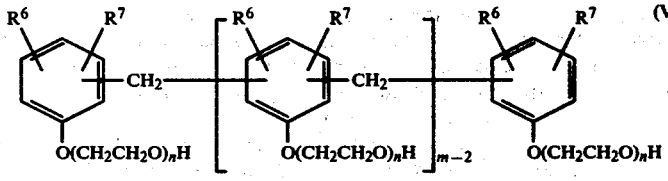

(VI)

where $R^6$ and $R^7$ which may be the same or different are each a hydrogen atom or an alkyl group (preferably an alkyl group having 1 to 9 carbon atoms) which may be substituted by fluorine atoms and m is about 2 to 50, and n is about 3 to 100

$$R^8O(CH_2CH_2O)_nR^9 \quad (VII)$$

where $R^8$ and $R^9$ which may be the same or different are each an alkyl group, wherein the sum total of carbon atoms in $R^8$ and $R^9$ is about 8 to 36 and n is about 5 to 100

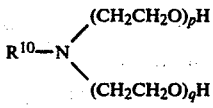

(VIII)

where $R^{10}$ is an alkyl group and preferably an alkyl group having 8 to 18 carbon atoms and p+q is about 5 to 100

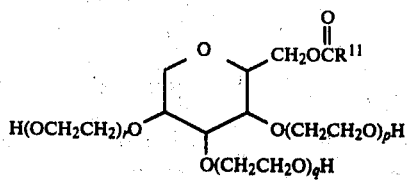

(IX)

where $R^{11}$ is an alkyl group and preferably an alkyl group having 7 to 17 carbon atoms and p+q+r is about 5 to 100

$$R^{12}O(\underset{\underset{CH_3}{|}}{C}HCH_2O)_m(CH_2CH_2O)_nH \quad (X)$$

where $R^{12}$ is an alkyl group and preferably an alkyl group having 4 to 22 carbon atoms and m is about 1 to 20 and n is about 5 to 100

$$R^{13}S(CH_2CH_2O)_nH \quad (XI)$$

where $R^{13}$ is an alkyl group and preferably an alkyl group having 4 to 18 carbon atoms and n is about 3 to 50

$$RfSO_2\underset{\underset{R^{14}}{|}}{N}CH_2CH_2O(CH_2CH_2O)_nH \quad (XII)$$

where Rf is a perfluoroalkyl group which preferably has 3 to 12 carbon atoms, $R^{14}$ is a $C_1$-$C_5$ alkyl group and n is about 3 to 100

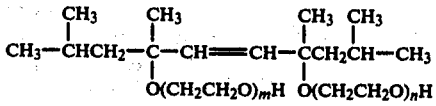

(XIII)

where m+n is about 5 to 50

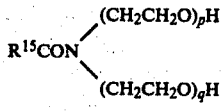

(XIV)

where $R^{15}$ is an alkyl group and preferably an alkyl group having 4 to 17 carbon atoms and p+q is about 3 to 100

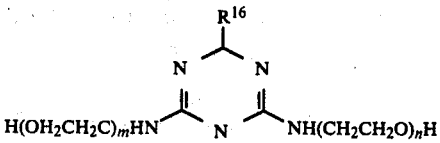

(XV)

where $R^{16}$ is an alkyl group and preferably an alkyl group having 7 to 18 carbon atoms and m+n is about 5 to 50

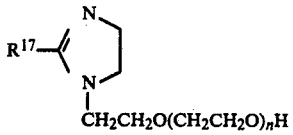

(XVI)

where $R^{17}$ is an alkyl group and preferably an alkyl group having 7 to 18 carbon atoms and n is about 5 to 100

In the above formulae the alkyl groups are generally straight chain or branched chain alkyl groups.

Among these polyoxyethylenes, particularly preferred compounds are as follows.

Compound 1

$C_{12}H_{25}O(CH_2CH_2O)_{10}H$

Compound 2

$$C_8F_{17}SO_2\underset{\underset{C_3H_7}{|}}{N}CH_2CH_2O(CH_2CH_2O)_{20}H$$

Compound 3

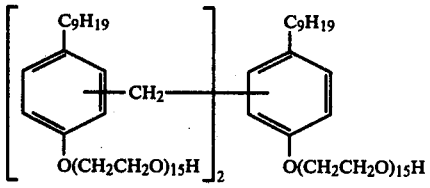

Compound 4

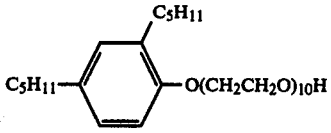

Compound 5

$$HO(CH_2CH_2O)_{11}(\underset{\underset{CH_3}{|}}{C}HCH_2O)_{16}(CH_2CH_2O)_{10}H$$

The inorganic salt used in the present invention is a thiocyanate, iodide, perchlorate or periodate.

The thiocyanates used in the present invention include alkali metal thiocyanates, alkaline earth metal thiocyanates and ammonium thiocyanates, and alkali metal thiocyanates are particularly preferred to use. Examples include potassium thiocyanate, sodium thiocyanate, lithium thiocyanate and rubidium thiocyanate. Particularly, potassium thiocyanate is preferred to use.

The iodides used in the present invention include alkali metal iodides, alkaline earth metal iodides and ammonium iodides, and alkali metal iodides are particularly preferred to use. Examples include potassium iodide, sodium iodide, rubidium iodide, lithium iodide and cesium iodide. Particularly, potassium iodide is preferred to use.

The perchlorates used in the present invention include alkali metal perchlorates, alkaline earth metal perchlorates, tetraalkyl ammonium perchlorates, pyridinium perchlorates, and perchloric acid salts of cationic polymers containing quaternary ammonium groups in side chains, and alkali metal perchlorates and alkaline earth metal perchlorates are particularly preferred to use. Examples include potassium perchlorate, sodium perchlorate, lithium perchlorate, rubidium perchlorate, cesium perchlorate, barium perchlorate, magnesium perchlorate, calcium perchlorate and strontium perchlorate. Particularly, it is preferred to use potassium perchlorate, sodium perchlorate, lithium perchlorate and calcium perchlorate from the viewpoint of degree of danger on treatment and toxic character.

An example of a perchloric acid salt of a cationic polymer is a polymer having the following unit:

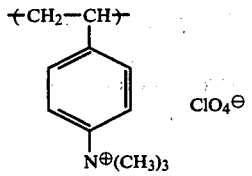

The periodates used in the present invention include alkali metal salts, alkaline earth metal salts, tetraalkylammonium salts, pyridinium salts and salts of quaternary ammonium type cationic polymers, etc., similar to the above-described perchlorates, and alkali metal salts and alkaline earth metal salts are particularly preferred to use. Particularly, potassium periodate, sodium periodate and lithium periodate are preferred to use.

Among the thiocyanates, iodides, perchlorates and periodates used in the present invention, perchlorates and periodates are particularly suitable in the view of their antistatic effect, and, particularly, the perchlorates are most preferred.

In the present invention, a very high antistatic effect can be obtained using the nonionic polyoxyethylene surface active agent together with at least one of thiocyanates, iodides, perchlorates and periodates as compared with the case of using the nonionic polyoxyethylene surface active agent alone. In the Hofmeister's series described in *Colloid Science*, p. 131, written by J. W. McBain (1950, Boston DC Hearth and Company), these salts belong to a group having a high "salting-in effect". In fact, it is believed that, since the salts of the present invention raise the cloud point (the temperature at which an aqueous solution of the nonionic polyoxyethylene surface active agent becomes cloudy) of the nonionic polyoxyethylene surface active agent, they have a function of salting-in the nonionic polyoxyethylene surface active agent.

In the present invention, though the nonionic polyoxyethylene compound and the salts selected from thiocyanates, iodides, perchlorates and periodates are contained in at least one layer of photographic layers, it is particularly preferred to incorporate them in an outside layer such as a surface protective layer and/or a back layer.

In application of the compounds having the antistatic effect using in the present invention to the photographic sensitive materials, they are added to a coating solution for at least one layer of the photographic sensitive material after being dissolved in water, an organic solution such as methanol, isopropanol or acetone, etc., or a mixture of water and said organic solvent, and the resulting coating solution is applied by di-coating, air-knife coating, extrusion coating using a hopper described in U.S. Pat. No. 2,681,294 or by a simultaneous application method with other photographic layers, as described in U.S. Pat. Nos. 3,508,947, 2,941,898 and 3,526,528, or the photographic layer is dipped in a solution of the above-described compounds.

The nonionic polyoxyethylene surface active agent and the thiocyanates, iodides, perchlorates and periodates in the present invention may be used in amounts sufficient to exhibit the antistatic effect. A preferred amount of the polyoxyethylene surface active agent is in the range of about 5 to 500 mg/m$^2$ and particularly about 20 to 200 mg/m$^2$. Further, a preferred amount of the salts used together therewith is in the range of about 5 to 500 mg/m$^2$ and particularly about 10 to 200 mg/m$^2$. Of course, the above-described ranges vary according to the type of the photographic film base, photographic composition, form or application method used. A suitable ratio for the amount of polyoxyethylene compound to salt is about 1:0.1 to 5.0 and preferably about 1:0.3 to 2 by weight.

As the bases of the photographic sensitive materials used in the present invention, there are, for example, cellulose acetate films, polyester films, polyethylene terephthalate films, polycarbonate films and laminates of them, and paper, etc. In greater detail, there is paper coated or laminated with baryta or $\alpha$-olefin polymers and, particularly, polymers of $\alpha$-olefin having 2 to 10 carbon atoms such as polyethylene, polypropylene or ethylene-butene copolymer, etc.

In the photographic sensitive materials of the present invention, each photographic layer may contain binders such as the following. For example, as hydrophilic colloids, there are proteins such as gelatin, colloidal albumin or casein, etc.; cellulose compounds such as carboxymethyl cellulose or hydroxyethyl cellulose, etc.; and synthetic hydrophilic colloids such as polyvinyl alcohol, poly-N-vinylpyrrolidone, polyacrylic acid copolymers, polyacrylamide or derivatives of them or partially hydrolyzed products of them, etc. If necessary, mixtures of two or more of these colloids are used. Among them, the most useful one is gelatin. The gelatin used here includes the so-called lime treated gelatin, acid treated gelatin and enzyme treated gelatin.

The silver halide emulsions in the photographic sensitive materials used in the present invention are produced, generally, by mixing a solution of water-soluble silver salts (for example, silver nitrate) and a solution of water-soluble halogenides (for example, potassium bromide) in the presence of a solution of water-soluble high molecular substances such as gelatin. As the silver halide, not only silver chloride and silver bromide but also mixed silver halide such as silver chlorobromide, silver iodobromide or silver chloroiodobromide, etc., may be used. Of course, it is useful to produce them by the so-called single jet process, double jet process or controlled double jet process, etc.

The sensitivity of the silver halide emulsions of the present invention can be increased by using chemical sensitizing agents (for example, sodium thiosulfate, N,N,N'-trimethyl thiourea, thiocyanate complex salt of monovalent gold, thiosulfate complex salt of monovalent gold, stannous chloride or hexamethylenetetramine, etc.) without increasing the particle size.

Further, various compounds may be added to the photographic emulsions of the photographic sensitive materials used in the present invention in order to prevent deterioration of sensitivity or occurrence of fog in the step for producing the sensitive materials, during preservation of them or during processing of them. As such compounds, there are quite many compounds which have been known hitherto, such as heterocyclic compounds, including 4-hydroxy-6-methyl-1,3,3a,7-tetrazaindene-3-methylbenzothiazole and 1-phenyl-5-mercaptotetrazole, mercury containing compounds, mercapto compounds and metal salts, etc.

In case that silver halide photographic emulsions are used as color photographic materials, couplers may be contained in the silver halide emulsion layers. Such couplers include 4-equivalent type diketomethylene yellow couplers, 2-equivalent type diketomethylene yellow couplers, 4- and 2-equivalent type pyrazolone magenta couplers, 4- and 2-equivalent type indazolone magenta couplers, α-naphthol cyan couplers and phenol cyan couplers, etc. In addition, it is possible to use couplers capable of releasing a development inhibiting agent described in U.S. Pat. Nos. 3,227,554, 3,297,445, 3,253,924, 3,311,476, 3,379,529, 3,516,831, 3,617,291, 3,705,801 and 3,770,436. The couplers may be dispersed by the process described in U.S. Pat. No. 2,801,171 to make dispersions.

The silver halide emulsion layers and other hydrophilic colloid layers in the photographic sensitive materials of the present invention can be hardened using various organic or inorganic hardening agents (alone or in combination). Preferred hardening agents have been described in, for example, *The Theory of the Photographic Process,* 3rd Edition (1966) written by C. E. K. Mees and T. H. James, U.S. Pat. Nos. 3,316,095, 3,232,764, 3,288,775, 2,732,303, 3,635,718, 3,232,763, 2,732,316, 2,586,168, 3,103,437, 3,017,280, 2,983,611, 2,725,294, 2,725,295, 3,100,704, 3,091,537, 3,321,313, 3,543,292 and 3,125,449 and British Pat. Nos. 994,869 and 1,167,027, etc.

In the photographic layers of the present invention, other surface active agents other than the nonionic polyoxyethylene compounds according to the present invention can be used for the purpose of improving coating property, dispersion by emulsification, sensitization or controlling electrostatic pressure, etc. These surface active agents are classified into natural surface active agents such as saponin, etc.; nonionic surface active agents such as alkylene oxide type, glycerine type or glucidol type agents; cationic surface active agents such as higher alkylamines, quaternary ammonium salts, pyridine or other heterocyclic substances, phosphonium or sulfonium substances, etc.; anionic surface active agents containing acid groups such as a carboxylic acid, sulfonic acid, phosphoric acid, sulfuric acid ester or phosphoric acid ester group, etc.; and ampholytic surface active agents such as aminoacids, aminosulfonic acids or sulfuric or phosphoric acid esters of aminoalcohols, etc. Among these surface active agents, anionic surface active agents, for example, N-oleoyl-N-methyltaurine sodium salt, sodium dioctylsulfosuccinate, N-lauroyl-N-carboxymethylglycine sodium salt and sodium dodecylbenzenesulfonate are preferred as application assistants.

Further, in the present invention, it is possible to contain lubricating compositions such as silicone described in U.S. Pat. Nos. 3,079,837, 3,080,317, 3,545,970 and 3,294,537 or polymer latexes described in U.S. Pat. Nos. 3,411,911 and 3,411,912 and Japanese Patent Publication No. 5331/70, etc., or plasticizers such as polyols described in U.S. Pat. Nos. 2,960,404, 3,042,524, 3,520,694, 3,656,956 and 3,640,721, etc.

Further, it is possible to contain matting agents such as silver halides, silica, strontium sulfate, barium sulfate or polymethyl methacrylate, etc.

By practicing the present invention, the problems caused by static charges generated in production and use are solved. For example, the occurrence of static marks caused by contact between the emulsion face and the back face of the photographic sensitive material, contact of one emulsion face with another emulsion face and contact of the photographic sensitive material with other materials such as rubber, metal, plastics and fluorescent sensitizing paper, etc., is remarkably reduced by practicing the present invention. Further, as described in the following examples, surface resistivity of the photographic sensitive materials remarkably decreases when the salts and polyoxyethylene compounds in the present invention are used together in gelatin and applied to the outside layer of the photographic sensitive materials.

Moreover, the combination of compounds used in the present invention very effectively prevent the static charges generated in setting the films in cassettes or loading them in cameras or in taking many photographs continuously at a high speed by an automatic camera such as in case of using X-ray films even in a low humidity and the antistatic effect does not deteriorate by the lapse of time.

The present invention is now illustrated in more detail by reference to the following examples. However, the present invention is not to be construed as being limited to these examples.

EXAMPLE 1

Samples (1) to (14) composed of a protective layer, an emulsion layer, a polyester base, an emulsion layer and a protective layer superposed in this order were produced by applying and drying according to the known method. The composition of each layer is set forth below.

Emulsion Layer

Binder: Gelatin 2.5 g/m$^2$
Silver content applied: 5 g/m$^2$
Composition of halide: AgI 1.5% by mol+AgBr 98.5 mol%
Hardening agent: Chromium alum 0.8 g/100 g binder
Antifogging agent: 1-Phenyl-5-mercaptotetrazole 0.5 g/Ag 100 g

Protective Layer

Binder: Gelatin 1.7 g/m$^2$ and potassium polystyrene sulfonate (molecular weight: about 70,000) 0.3 g/m$^2$
Hardening agent: 2-Hydroxy-4,6-dichloro-s-triazine sodium salt 0.4 g/100 g binder
Application assistant: N-Oleoyl-N-methyltaurine sodium salt 7 mg/m$^2$ Sample (1) was composed of only the above-described composition. Samples (2) to (14) had the same composition as that of Sample (1) except that an antistatic composition shown in Table 1 was added to the protective layer.

The antistatic property of these samples was examined in the following manner.

(a) Measurement of Surface Resistivity:

A sample was put between brass electrodes having 10 cm of the length placed at 0.14 cm of the electrode interval (the part contacting with the sample was made of stainless steel). Electric current was measured 1 minute later by an electrometer (TR-8651) made by Takeda Riken Co. (this measurement was carried out under a condition at 25° C. and 25% RH), and surface resistivity was calculated according to Ohm's law. It is shown that the smaller the value of surface resistivity is, the more excellent the antistatic property is.

(b) Occurrence of Static Mark:

A white rubber plate was put on the surface of the unexposed sample and the white rubber plate was pressed by a rubber roll under a condition at 25° C. and 30% RH to cause a nearly constant friction. After the white rubber plate was removed and the sample was developed, fixed and washed with water. The occurrence of static mark was examined. Of course, the smaller the occurrence of static mark is, the more excellent the antistatic property is.

Results obtained by examining the antistatic property of the above-described Samples (1) to (14) are shown in Table 1.

TABLE 1

| Sample | Polyoxyethylene Compound Compound No. | Amount ($mg/m^2$) | Salt | Amount of Salt ($mg/m^2$) | Surface Resistivity (Ω) | Occurrence of* Static Mark | Note |
|---|---|---|---|---|---|---|---|
| (1) | None | — | None | — | $3.1 \times 10^{14}$ | C | Blank |
| (2) | 1 | 50 | None | — | $5.0 \times 10^{12}$ | B | Control |
| (3) | 1 | 50 | $KNO_3$ | 50 | $3.1 \times 10^{12}$ | B | Comparison |
| (4) | 1 | 50 | $KNO_3$ | 250 | $1.6 \times 10^{12}$ | B | Comparison |
| (5) | 1 | 50 | NaCl | 50 | $4.5 \times 10^{12}$ | B | Comparison |
| (6) | 1 | 50 | NaCl | 250 | $2.8 \times 10^{12}$ | B | Comparison |
| (7) | 1 | 50 | $KClO_4$ | 69 [The same mol as (3)] | $8.7 \times 10^{10}$ | A | Invention |
| (8) | 1 | 50 | $NaClO_4$ | 105 [The same mol as (5)] | $2.4 \times 10^{11}$ | A | Invention |
| (9) | 1 | 50 | $NaIO_4$ | 183 [The same mol as (5)] | $6.2 \times 10^{11}$ | A | Invention |
| (10) | 1 | 50 | KSCN | 48 [The same mol as (3)] | $3.4 \times 10^{11}$ | A | Invention |
| (11) | 1 | 50 | KI | 82 [The same mol as (3)] | $9.2 \times 10^{11}$ | A | Invention |
| (12) | 4 | 50 | $KNO_3$ | 50 | $8.1 \times 10^{12}$ | B–C | Comparison |
| (13) | 4 | 50 | $KClO_4$ | 69 [The same mol as (12)] | $1.1 \times 10^{11}$ | A | Invention |
| (14) | None | — | KSCN | 250 | $3.5 \times 10^{13}$ | C | Comparison |

*A: occurrence of static mark is hardly observed, B: occurrence of static mark is somewhat observed, C: occurrence of static mark is observed on nearly the entire surface It is understood from Table 1 that, in cases that salts for comparison are used together with the polyoxyethylene compound (Samples (3) to (6)), the surface resistivity does not reduce excessively even though the amount of salts increases, but, in cases that the salts of the present invention are used together (Samples (7) to (11)), the surface resistivity remarkably reduces and occurrence of static mark is hardly observed. It is understood that the effect by the salts of the present invention does not vary by changing the polyoxyethylene compound into another one and the antistatic property is remarkably improved by using the salts of the present invention together (Samples (12) and (13)). It is also understood that the antistatic effect is hardly shown by use of the salts of the present invention alone (Sample (14)).

EXAMPLE 2

Samples (21) to (26) composed of a triacetyl cellulose base, an emulsion layer and a protective layer superposed in this order were produced by applying and drying according to the conventional method. Composition of each layer is shown in the following.

Emulsion Layer:

Binder: Gelatin 14 $g/m^2$
Silver content applied: 7 $g/m^2$
Composition of silver halide: AgI 5% by mol and AgBr 95% by mol
Hardening agent: N,N'-Glutalyldioxydisuccinimide 1.5 g/100 g binder
Antifogging agent: 4-Hydroxy-6-methyl-1,3,3a,7-tetrazaindene 0.5 g/Ag 100 g Protective Layer:

Binder: Gelatin 1.8 $g/m^2$ and cellulose sulfate having 100,000 of the average molecular weight 0.5 $g/m^2$
Hardening agent: Mucochloric acid 0.8 g/100 g binder and
N,N'-dimethylol urea 0.5 g/100 g binder
Application assistant: Sodium dioctylsulfosuccinate 5 $mg/m^2$ Sample (21) was composed of only the above-described composition. Samples (22) to (26) had the same composition as that of Sample (21) except that 60 $mg/m^2$ of Compound 2 and salts shown in Table 2 were added to the protective layer.

The results obtained by examining the antistatic property of these samples are shown in Table 2. Further, in order to examine an electrification property, an amount of electrostatic charges was measured after rubbing each sample by a rubber roll.

TABLE 2

| Sample | Salt | Amount of Salt ($mg/m^2$) | Surface Resistivity (Ω) | Occurrence of Static Mark | Amount of Charges (V) | Note |
|---|---|---|---|---|---|---|
| (21) | None | — | $8.3 \times 10^{12}$ | B | 200 | Control |
| (22) | $KNO_3$ | 50 | $6.4 \times 10^{12}$ | B | 180 | Comparison |
| (23) | $KNO_3$ | 250 | $4.7 \times 10^{12}$ | B | 170 | Comparison |

TABLE 2-continued

| Sample | Salt | Amount of Salt ($mg/m^2$) | Surface Resistivity (Ω) | Occurrence of Static Mark | Amount of Charges (V) | Note |
|---|---|---|---|---|---|---|
| (24) | $KClO_4$ | 69 [The same mol as (22)] | $1.3 \times 10^{11}$ | A | 50 | Invention |
| (25) | $Ca(ClO_4)_2$ | 50 | $3.5 \times 10^{11}$ | A | 70 | Invention |
| (26) | KSCN | 48 [The same mol as (22)] | $5.4 \times 10^{11}$ | A | 80 | Invention |

It is understood from Table 2 that, when the salts of the present invention are used together with Compound 2, the surface resistivity is remarkably reduced and the amount of electrostatic charges decreases at the same time, by which the antistatic property is remarkably improved.

EXAMPLE 3

Samples (31) to (39) composed of a back layer, a triacetyl cellulose base, an emulsion layer and a protective layer superposed in this order were produced by applying and drying according to the conventional method. Composition of each layer is shown in the following.

Protective Layer

Binder: Gelatin 1.9 $g/m^2$
Hardening agent: 2,3-Dihydroxydioxane 1.5 g/100 g binder
Matting agent: Silica having 4μ of the average particle size 20 $mg/m^2$
Application assistant: Sodium dodecylbenzenesulfonate 28 $mg/m^2$

Emulsion Layer

Binder: Gelatin 14 $g/m^2$
Silver content applied: 5 $g/m^2$
Composition of silver halide: AgI 0.1% by mol, AgBr 25% by mol and AgCl 74.9% by mol
Antifogging agent: 4-Hydroxy-6-methyl-1,3,3a,7-tetrazaindene 0.6 g/Ag 100 g

Back Layer

Binder: Gelatin 0.5 $g/m^2$ and diacetyl cellulose 0.1 $g/m^2$
Hardening agent: Glyoxal 1.5 g/100 g binder
Application assistant: N-Lauroyl-N-carboxymethylglycine sodium salt 15 $mg/m^2$ Sample (31) was composed of only the above-described composition. Sample (32) had the same composition as that of Sample (31) except that 100 $mg/m^2$ of Compound 1 was contained in the back layer. Samples (33) to (39) had the same composition as that of Sample (32) except that salts shown in Table 3 were added to the back layer.

Results obtained by examining the antistatic property of these samples are shown in Table 3.

TABLE 3

| Sample | Salt | Amount of Salt ($mg/m^2$) | Surface Resistivity (Ω) | Occurrence of Static Mark | Note |
|---|---|---|---|---|---|
| (31) | None | — | $5.3 \times 10^{14}$ | C | Blank |
| (32) | None | — | $4.1 \times 10^{13}$ | C | Control |
| (33) | KBr | 30 | $1.9 \times 10^{13}$ | C | Comparison |
| (34) | KBr | 100 | $8.1 \times 10^{12}$ | B–C | Comparison |
| (35) | $KClO_4$ | 35 [The same mol as (33)] | $7.0 \times 10^{10}$ | A | Invention |
| (36) | $LiClO_4$ | 30 | $9.4 \times 10^{10}$ | A | Invention |
| (37) | KSCN | 24 [The same mol as (33)] | $3.7 \times 10^{11}$ | A | Invention |
| (38) | KI | 42 [The same mol as (33)] | $6.6 \times 10^{11}$ | A | Invention |
| (39) | $KIO_4$ | 58 [The same mol as (33)] | $4.5 \times 10^{11}$ | A | Invention |

It is understood from Table 3 that the antistatic property is remarkably improved if the salts of the present invention are used together with Compound 1.

EXAMPLE 4

Samples (41) to (47) composed of a triacetyl cellulose base, an antihalation layer, a red-sensitive layer, an intermediate layer, a green-sensitive layer, a yellow filter layer, a blue-sensitive layer and a protective layer superposed in this order were produced by applying and drying according to the conventional method. Composition of each layer is shown in the following.

Antihalation Layer

Binder: Gelatin 4.4 $g/m^2$
Hardening agent: Bis(vinylsulfonylmethyl)ether 5 g/100 g binder
Application assistant: Sodium dodecylbenzenesulfonate 4 $mg/m^2$
Antihalation agent: Black colloidal silver 0.4 $g/m^2$

Red-Sensitive Layer

Binder: Gelatin 7 $g/m^2$
Hardening agent: 2-Hydroxy-4,6-dichloro-s-triazine sodium salt 0.7 g/100 g binder and bis(vinylsulfonylmethyl)-ether 2 g/100 g binder
Application assistant: Sodium dodecylbenzenesulfonate 10 $mg/m^2$
Silver content applied: 3.1 $g/m^2$
Composition of silver halide: AgI 2% by mol+AgBr 98% by mol
Antifogging agent: 4-Hydroxy-6-methyl-1,3,3a,7-tetrazaindene 0.9 g/100 g Ag
Coupler: 1-Hydroxy-4-(2-acetylphenyl)azo-N-[4-(2,4-di-tert-amylphenoxy)butyl]-2-naphthamide 38 g/100 g Ag Sensitizing dye: Anhydro-5,5'-dichloro-9-ethyl-3,3'-di-(3-sulfopropyl)thiacarbocyanine hydroxide pyridinium salt 0.3 g/100 g Ag Intermediate Layer Binder: Gelatin 2.6 g/m$^2$
Hardening agent: Bis(vinylsulfonylmethyl)ether 6 g/100 g binder
Application assistant: Sodium dodecylbenzenesulfonate 12 mg/m$^2$ Green-Sensitive Layer Binder: Gelatin 6.4 g/m$^2$
Hardening agent: 2-Hydroxy-4,6-dichloro-s-triazine sodium salt 0.7 g/100 g binder+bis(binylsulfonylmethtyl)ether 2 g/100 g binder
Application assistant: Sodium dodecylbenzenesulfonate 9 mg/m$^2$
Silver content applied: 2.2 g/m$^2$
Composition of silver halide: AgI 3.3% by mol+AgBr 96.7% by mol
Stabilizing agent: 4-Hydroxy-6-methyl-1,3,3a,7-tetrazaindene 0.6 g/100 g Ag
Coupler: 1-(2,4,6-Trichlorophenyl)-3-[3-(2,4-di-tert-amylphenoxy)acetamide]-4-(4-methoxyphenyl)azo-5-pyrazolone 37 g/100 g Ag
Sensitizing dye: Anhydro-5,5'-diphenyl-9-ethyl-3,3'-di(2-sulfoethyl)oxacarbocyanine hydroxide pyridinium salt 0.3 g/100 g Ag Yellow Filter Layer Binder: Gelatin 2.3 g/m$^2$
Filter component: Yellow colloidal silver 0.7 g/m$^2$
Hardening agent: Bis(vinylsulfonylmethyl)ether 5 g/100 g binder
Surface active agent: Sodium di-(2-ethylhexyl)-α-sulfosuccinate 7 mg/m$^2$ Blue-Sensitive Layer Binder: Gelatin 7 g/m$^2$
Hardening agent: 2-Hydroxy-4,6-dichloro-s-triazine sodium salt 0.7 g/100 g binder and bis(vinylsulfonylmethyl)-ether 2 g/100 g binder
Application assistant: Sodium dodecylbenzenesulfonate 8 mg/m$^2$
Silver content applied: 2.2 g/m$^2$
Composition of silver halide: AgI 3.3% by mol+AgBr 96.7% by mol
Stabilizing agent: 4-Hydroxy-6-methyl-1,3,3a,7-tetrazaindene 0.4 g/100 g Ag
Coupler: 2'-Chloro-5'-[2-(2,4-di-tert-amylphenoxy)-butylamide]-α-(5,5'-dimethyl-2,4-dioxo-3-oxazolidinyl)-α-(4-methoxybenzoyl)acetanilide 45 g/100 g Ag Protective Layer Binder: Gelatin 2 g/m$^2$ and styrene-maleic acid anhydride (1:1) copolymer having about 100,000 of the average molecular weight 0.3 g/m$^2$
Hardening agent: Bis(vinylsulfonylmethyl)ether 5 g/100 g binder
Application assistant: Sodium dioctylsulfosuccinate 5 mg/m$^2$ The sample (41) was composed of only the above-described compositions. Sample (42) had the same composition as that of Sample (41) except that 50 mg/m$^2$ of Compound 5 was contained in the protective layer. Samples (43) to (47) had the same composition as that of Sample (42) except that salts shown in Table 4 were added to the protective layer.

TABLE 4

| | Polyoxyethylene Compound | | | | | | |
|---|---|---|---|---|---|---|---|
| Sample | Compound No. | Amount (mg/m$^2$) | Salt | Amount of Salt | Surface Resistivity (Ω) | Occurrence of Static Mark | None |
| (41) | None | — | None | — | $1.5 \times 10^{14}$ | C | Blank |
| (42) | 5 | 50 | None | — | $6.3 \times 10^{12}$ | B | Control |
| (43) | 5 | 50 | KCl | 50 | $5.1 \times 10^{12}$ | B | Comparison |
| (44) | 5 | 50 | KCl | 250 | $2.2 \times 10^{12}$ | B | Comparison |
| (45) | 5 | 50 | $KClO_4$ | 93 [The same mol as (43)] | $8.3 \times 10^{10}$ | A | Invention |
| (46) | 5 | 50 | $KIO_4$ | 154 [The same mol as (43)] | $1.7 \times 10^{11}$ | A | Invention |
| (47) | 5 | 50 | RbI | 50 | $7.4 \times 10^{11}$ | A | Invention |

It is understood from Table 4 that the antistatic property is remarkably improved, if the salts of the present invention are used together with Compound 5.

EXAMPLE 5

The same photosensitive material as Sample (1) in Example 1 was prepared and dipped in each aqueous solution shown in Table 5. It was then dried in the air at 25° C. of the dry-bulb temperature and 65% of the relative humidity. Results obtained by measuring the antistatic property of Samples (51) to (56) are shown in Table 5.

TABLE 5

| | Composition of Dipping Solution | | | | | |
|---|---|---|---|---|---|---|
| | Polyoxyethylene Compound | | Salt | | | |
| Sample | Compound No. | Amount (g/l) | Used | Amount (g/l) | Surface Resistivity (Ω) | Note |
| (51) | None | — | None | — | $1.3 \times 10^{14}$ | Blank |
| (52) | 1 | 20 | None | — | $7.6 \times 10^{11}$ | Control |
| (53) | 1 | 20 | $KNO_3$ | 10 | $5.4 \times 10^{11}$ | Comparison |
| (54) | 1 | 20 | $KNO_3$ | 50 | $4.2 \times 10^{11}$ | Comparison |
| (55) | 1 | 20 | $KClO_4$ | 14 [The same mol as (53)] | $1.9 \times 10^{10}$ | Invention |
| (56) | 1 | 20 | KSCN | 10 | $7.9 \times 10^{10}$ | Invention |

TABLE 5-continued

| Sample | Composition of Dipping Solution: Polyoxyethylene Compound: Compound No. | Amount (g/l) | Salt: Used | Amount (g/l) | Surface Resistivity (Ω) | Note |
|---|---|---|---|---|---|---|
| | | | [The same mol as (53)] | | | |

It is understood from Table 5 that the surface resistivity remarkably reduces even if the aqueous solution containing the salts of the present invention together with Compound 1 is applied by dipping.

While the invention has been described in detail and with reference to specific embodiments thereof, it will be apparent to one skilled in the art that various changes and modifications can be made therein without departing from the spirit and scope thereof.

What is claimed is:

1. A photographic sensitive material having an improved antistatic property which comprises a nonionic polyoxyethylene surface active agent and at least one of an alkali metal thiocyanate, alkali metal and alkaline earth metal iodide, alkali metal and alkaline earth metal perchlorate and alkali metal periodate in at least one layer.

2. The photographic sensitive material of claim 1, wherein said nonionic polyoxyethylene surface active agent is one which in aqueous solution gives a surface tension of about 45 dynes/cm or less at a concentration higher than the critical micelle concentration.

3. The photographic sensitive material of claim 1, wherein said polyoxyethylene agent and said thiocyanate, iodide, perchlorate, and periodate are incorporated into at least one of a surface layer and a back layer.

4. The photographic sensitive material of claim 1, wherein said material is an X-ray sensitive film.

5. The photographic sensitive material of claim 1, wherein said polyoxyethylene agent is present in said layer in an amount of about 5 to 500 mg/m$^2$.

6. The photographic sensitive material of claim 1, wherein said thiocyanate, iodide, perchlorate and periodate are present in said layer in an amount of about 5 to 500 mg/m$^2$.

7. The photographic sensitive material of claim 1, wherein the ratio of said polyoxyethylene agent to said thiocyanate, iodide, perchlorate and periodate is about 1:0.1 to 1:5.0 by weight.

8. The photographic sensitive material of claim 2, wherein said polyoxyethylene is represented by one of the formulae (I) to (XVI):

$$HO(CH_2CH_2O)_a(\underset{\underset{CH_3}{|}}{C}HCH_2O)_b(CH_2CH_2O)_cH \quad (I)$$

where a+c is about 10 to 80, wherein either a or c may be 0 and b is about 5 to 200;

$$RCOO(CH_2CH_2O)_nH \quad (II)$$

where R is an alkyl group having 3 to 21 carbon atoms and n is about 5 to 135;

$$R^1COO(CH_2CH_2O)_nOCR^2 \quad (III)$$

where $R^1$ and $R^2$ which may be the same or different each represents an alkyl group, wherein the sum total of carbon atoms in $R^1$ and $R^2$ is preferably 6 to 34 and n is about 5 to 100;

$$R^3O(CH_2CH_2O)_nH \quad (IV)$$

where $R^3$ is an alkyl group having 4 to 22 carbon atoms, which may be substituted by fluorine atoms and n is about 3 to 50;

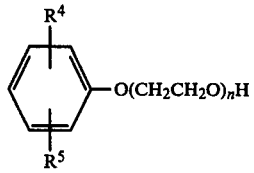

(V)

where $R^4$ and $R^5$ which may be the same or different are each a hydrogen atom or an alkyl group having 1 to 9 carbon atoms which may be substituted by fluorine atoms and n is about 3 to 150;

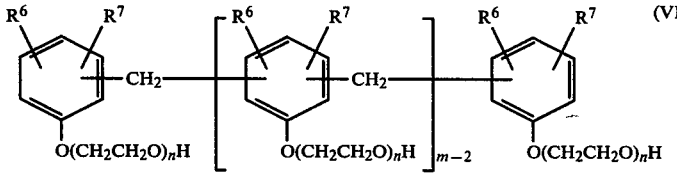

(VI)

where $R^6$ and $R^7$ which may be the same or different are each a hydrogen atom or an alkyl group having 1 to 9 carbon atoms which may be substituted by fluorine atoms and m is about 2 to 50, and n is about 3 to 100;

$$R^8O(CH_2CH_2O)_nR^9 \quad (VII)$$

where $R^8$ and $R^9$ which may be the same or different are each an alkyl group, wherein the sum total of carbon atoms in $R^8$ and $R^9$ is about 8 to 36 and n is about 5 to 100;

$$R^{10}-N\begin{matrix}(CH_2CH_2O)_pH \\ (CH_2CH_2O)_qH\end{matrix} \quad (VIII)$$

where $R^{10}$ is an alkyl group having 8 to 18 carbon atoms and p+q is about 5 to 100;

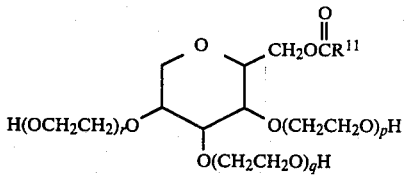

(IX)

where $R^{11}$ is an alkyl group having 7 to 17 carbon atoms and p+q+r is about 5 to 100;

$$R^{12}O(\underset{\underset{CH_3}{|}}{C}HCH_2O)_m(CH_2CH_2O)_nH \quad (X)$$

where $R^{12}$ is an alkyl group having 4 to 22 carbon atoms and m is about 1 to 20 and n is about 5 to 100;

$$R^{13}S(CH_2CH_2O)_nH \quad (XI)$$

where $R^{13}$ is an alkyl group having 4 to 18 carbon atoms and n is about 3 to 50;

$$RfSO_2\underset{\underset{R^{14}}{|}}{N}CH_2CH_2O(CH_2CH_2O)_nH \quad (XII)$$

where Rf is a perfluoroalkyl group which has 3 to 12 carbon atoms, $R^{14}$ is a $C_1$-$C_5$ alkyl group and n is about 3 to 100;

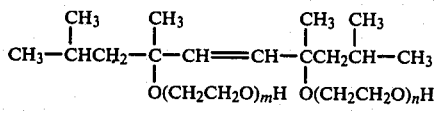

(XIII)

where m+n is about 5 to 50;

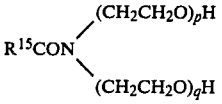

(XIV)

where $R^{15}$ is an alkyl group having 4 to 17 carbon atoms and p+q is about 3 to 100;

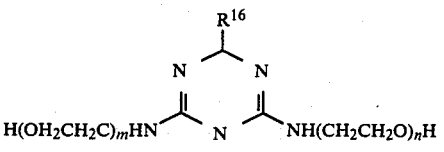

(XV)

where $R^{16}$ is an alkyl group having 7 to 18 carbon atoms and m+n is about 5 to 50; or

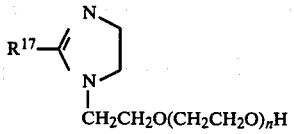

(XVI)

where $R^{17}$ is an alkyl group having 7 to 18 carbon atoms and n is about 5 to 100.

9. The photographic sensitive material of claim 1, wherein said nonionic polyoxyethylene surface active agent and said alkali metal perchlorate are incorporated into at least one layer.

10. A process for preventing the generation of static charges in a photographic sensitive material which comprises incorporating into at least one layer of said photographic sensitive material, a nonionic polyoxyethylene surface active agent and at least one of an alkali metal thiocyanate, alkali metal and alkaline earth metal iodide, perchlorate, and alkali metal periodate.

* * * * *